US005228197A

United States Patent [19]

Cox et al.

[11] Patent Number: 5,228,197

[45] Date of Patent: Jul. 20, 1993

[54] REFRIGERANT COIL FABRICATION METHODS

[75] Inventors: Jimmy L. Cox, Greenwood; John B. Greenfield; Fort Smith; Kendall L. Ross, Greenwood, all of Ark.

[73] Assignee: Rheem Manufacturing Company, New York, N.Y.

[21] Appl. No.: 857,476

[22] Filed: Mar. 25, 1992

Related U.S. Application Data

[62] Division of Ser. No. 638,825, Jan. 8, 1991, Pat. No. 5,121,613.

[51] Int. Cl.[5] ..... B21D 53/00

[52] U.S. Cl. ..... 29/890.0.35; 29/890.046; 29/890.049; 29/469

[58] Field of Search ..... 29/469, 890.03, 890.035, 29/890.047, 890.049; 62/419, 515, 524; 165/126, 127, 133, 150, 179

[56] References Cited

U.S. PATENT DOCUMENTS 4,319,461 3/1982 Shaw ..... 62/93

4,470,271 9/1984 Draper et al. ..... 62/259.1

4,545,428 10/1985 Onishi et al. ..... 165/110

4,898,232 2/1990 Ochiai et al. ..... 29/890.035 X

*Primary Examiner*—Mark Rosenbaum

*Assistant Examiner*—S. Thomas Hughes

*Attorney, Agent, or Firm*—Konneker, Bush & Hitt

[57] ABSTRACT

Using a series of identically sized, single row, single circuit refrigerant coil modules, fin/tube refrigerant coils of different nominal air conditioning tonnages are constructed by arranging different numbers of the identically sized modules in accordion-pleated orientations, with each modular coil having the same depth in the direction of intended air flow across the coil. Compared to conventional "A" coils used on the indoor side of air conditioning circuits, these accordion-pleated modular coils are more compact in the air flow direction, provide more coil surface area, permit lower coil face velocities with higher fin density, and significantly reduce the overall coil manufacturing costs since only one size of coil slab needs to be fabricated and inventoried to later assemble refrigerant coils of widely varying nominal air conditioning tonnages.

7 Claims, 4 Drawing Sheets

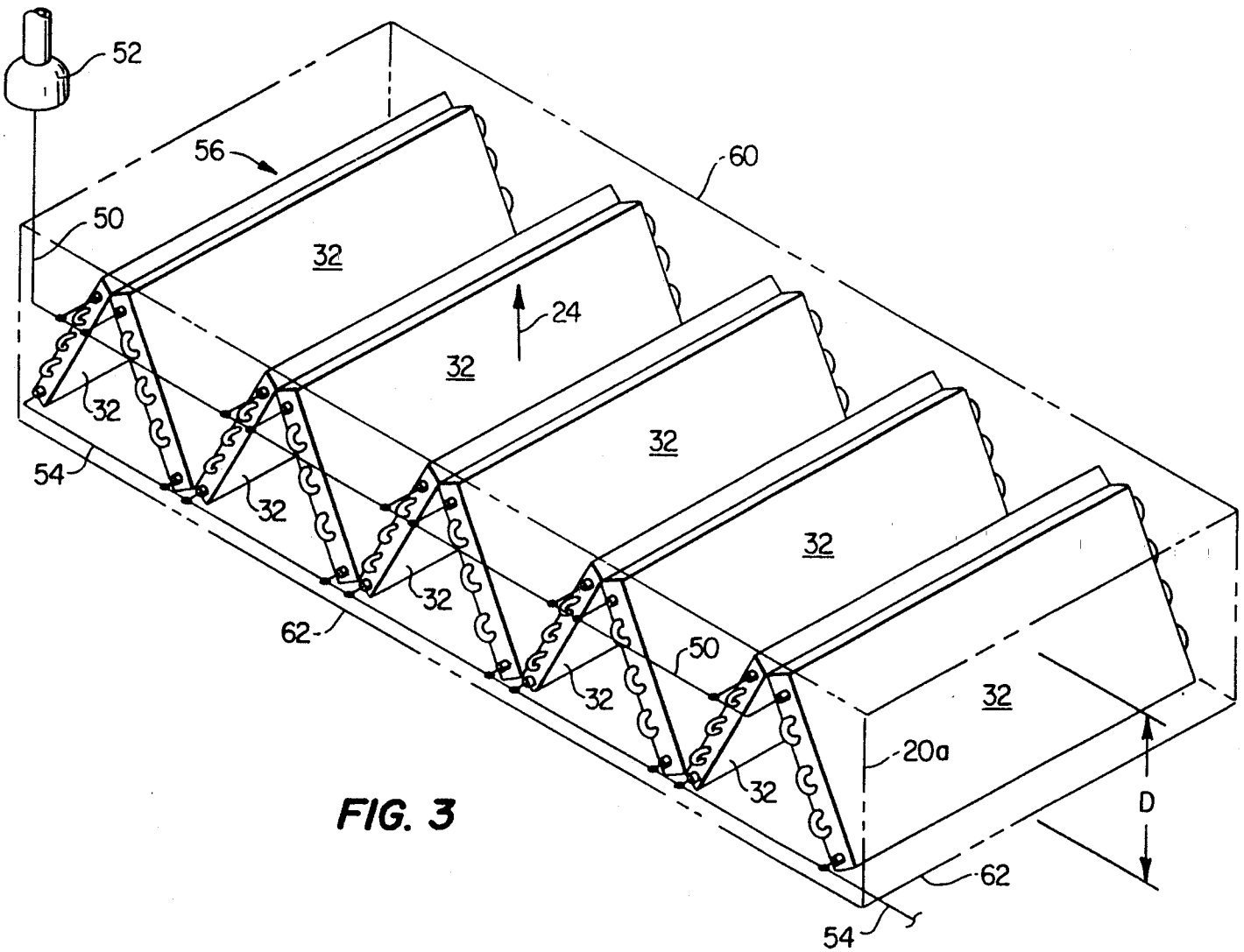
60
52
50
56
32
24
32
32
32

REFRIGERANT COIL FABRICATION METHODS

This is a division of application Ser. No. 638,825, filed Jan. 8, 1991, now U.S. Pat. No. 5,121,613

BACKGROUND OF THE INVENTION

The present invention relates generally to air conditioning and heat pump systems and more particularly, but not by way of limitation, relates to refrigerant coils used therein.

The typical indoor coil utilized with heating and cooling indoor equipment is conventionally of an inverted "V" configuration defined by two multi-row, multi-circuit fin/tube refrigerant coil slabs across which air to be cooled is flowed on its way to the conditioned space served by a furnace or air handler Indoor coils of this type (commonly referred to as "A"-coils in the air conditioning industry) are offered in various nominal tonnages, one air conditioning "ton" being equal to an air cooling capacity of 12,000 BTU/HR. Furnaces and other air handling equipment using this type of coil are normally offered to the residential or commercial customer in an appropriate range of air conditioning tonnages which are established by the size of the A-coil installed in the furnace, or other type of air handler, in conjunction with the correspondingly sized condenser side of the overall refrigeration circuitry.

A representative air conditioning tonnage range for residential furnace applications is, for example, one to five tons, while a representative light commercial tonnage range would be from five to twenty tons. Within this overall cooling capacity range, the tonnage increment between successively larger capacity A-coils is typically ½, 1, 2½ or 5 tons, with the tonnage increments usually being smaller at the lower end of the capacity spectrum.

Conventional refrigerant "A" coils have been the norm in this general furnace and air handler tonnage range for many years and have been, generally speaking, well suited for their intended purpose However, they are also subject to a variety of well-known problems, limitations and disadvantages, particularly as pertains to their manufacture and incorporation in their associated furnaces, air handlers or the like.

For example, for each A-coil within a given multi-tonnage set thereof, it has heretofore been necessary to manufacture and inventory a differently sized pair of refrigerant coil slabs. As an example, if a manufacturer produces a line of heating and air conditioning equipment having a cooling range of from 1½ to 20 tons, there may representatively be twelve different capacity A-coils needed-e.g., A-coils of 1½, 2, 2½, 3, 3½, 4, 5, 7½, 10, 12½, 15 and 20 ton nominal air cooling capacities. Accordingly, twelve differently sized refrigerant coil slabs must be manufactured and inventoried.

This conventional necessity increases both tooling costs and manufacturing floor space requirements, thereby also increasing the overall manufacturing costs associated with the air conditioning systems into which the A-coils are incorporated. Additionally, each of the A-coils in a necessary capacity range thereof will typically have different depths in the direction of intended air flow therethrough. For example, in up-flow furnaces, progressively larger capacity A-coils will have correspondingly increasing vertical installation height requirements. This can result in the necessity of oversizing the cabinet height of an air handler to accommodate A-coils of varying heights. Moreover, in an attempt to reduce the number of differently dimensioned refrigerant coil slabs which must be manufactured and inventoried to assemble A-coils of the necessary different refrigeration capacities, many manufacturers provide relatively large capacity increments at the upper end of their capacity range. For example, in light commercial air conditioning equipment, the highest capacity unit may be 20 tons, while the next smaller unit may be 15 tons. If the system designer determines that, for the conditioned spaced to be served by the equipment, an air conditioning capacity of 16 tons is needed, he normally must select the 20 ton unit. This undesirably results in a 25% oversizing of the air conditioning system.

In view of the foregoing, it can be seen that it would be desirable to provide a refrigerant coil structure, and manufacturing methods associated therewith, which eliminate or at least substantially reduce the above-mentioned and other problems, limitations and disadvantages heretofore associated with conventional "A-coils" used as the indoor coils of air conditioning and heat pump systems.

SUMMARY OF THE INVENTION

In carrying out principles of the present invention, in accordance with a preferred embodiment thereof, a series of identically sized flat refrigerant coil modules are utilized to form a plurality of air cooling or heating refrigerant coils of different nominal air conditioning tonnages, the coils having a different number of the modules arranged in an accordion pleated orientation.

Each of the identically sized modules is defined by a single row of parallel, laterally spaced apart heat exchange tubes serially interconnected to form a single refrigerant circuit having an inlet end for receiving refrigerant from a source thereof, and an outlet end for discharging the received refrigerant. A longitudinally spaced series of heat exchange fins are transversely connected to the heat exchange tubes.

The modular, accordion pleated fin/tube refrigerant coils of the present invention are particularly well suited as replacements for the two-slab "A-coils" conventionally incorporated in combination heating and air conditioning furnaces and the like and provide a variety of manufacturing and other advantages compared to such A-coils. For example, only one size flat refrigerant coil slab needs to be manufactured and inventoried since the accordion pleated refrigerant coil assemblies of the present invention are all fashioned from varying numbers of the identically sized coil modules. Additionally, the use of these identically sized coil modules permits the varying capacity coil assemblies which they define to have identical depths in the intended air flow direction across the coils. In turn, this permits the allocated dimensions of the coil housing or air handler, in the direction of air flow therethrough, to be essentially uniform for each furnace in a manufacturing series thereof.

Compared to conventional A-coils, the accordion pleated coils of the present invention, which are preferably defined by three or more coil modules, provide a substantially increased coil face area. For a given flow rate across the coils, during furnace or air handler operation, this increased face area reduces the coil face velocity of the air to a magnitude considerably below the minimum design velocity typically associated with A-coils. Specifically, the accordion pleated module coils of the present invention are preferably sized to provide operating face velocities in the range of from approximately 100 feet per minute to approximately 200 feet per minute.

While under conventional refrigerant coil design wisdom this unusually low coil face velocity is considered undesirable, it uniquely permits the accordion pleated modular coils of the present invention to be provided with very closely spaced heat exchange fins which are of an enhanced, slotted construction, to thereby substantially increase the air-to-fin heat exchange efficiency without increasing the air pressure drop across the accordion pleated coil to a level beyond that normally associated with conventional A-coils. Specifically, the modular coils of the present invention are designed to operate at an air side pressure drop of less than about 0.10".

To further improve the overall heat exchange efficiency of the accordion pleated coils, the primary heat exchange efficiency (i.e., the heat exchange occurring between the refrigerant and the coil tubes) is also increased by providing the tubes with an enhanced construction, preferably by forming internal grooves within the tubes.

In a preferred embodiment of the accordion pleated refrigerant coils, the identically sized refrigerant coil modules used to define the coils have a nominal air conditioning tonnage capacity of 0.5 tons (6,000 BTU/HR.). This, of course, provides the ability to set the coil-to-coil tonnage increments correspondingly at 6,000 BTU/HR. This very desirably reduced capacity increment, in turn; provides the system designer with the ability to very precisely match the indoor side of the overall air conditioning circuitry to the conditioned space building load requirements.

BRIEF DESCRIPTION OF THE DRAWINGS

FIG. 3 is a perspective view of a representative larger tonnage version of the FIG. 2 modular coil;

DETAILED DESCRIPTION

Figure 1:
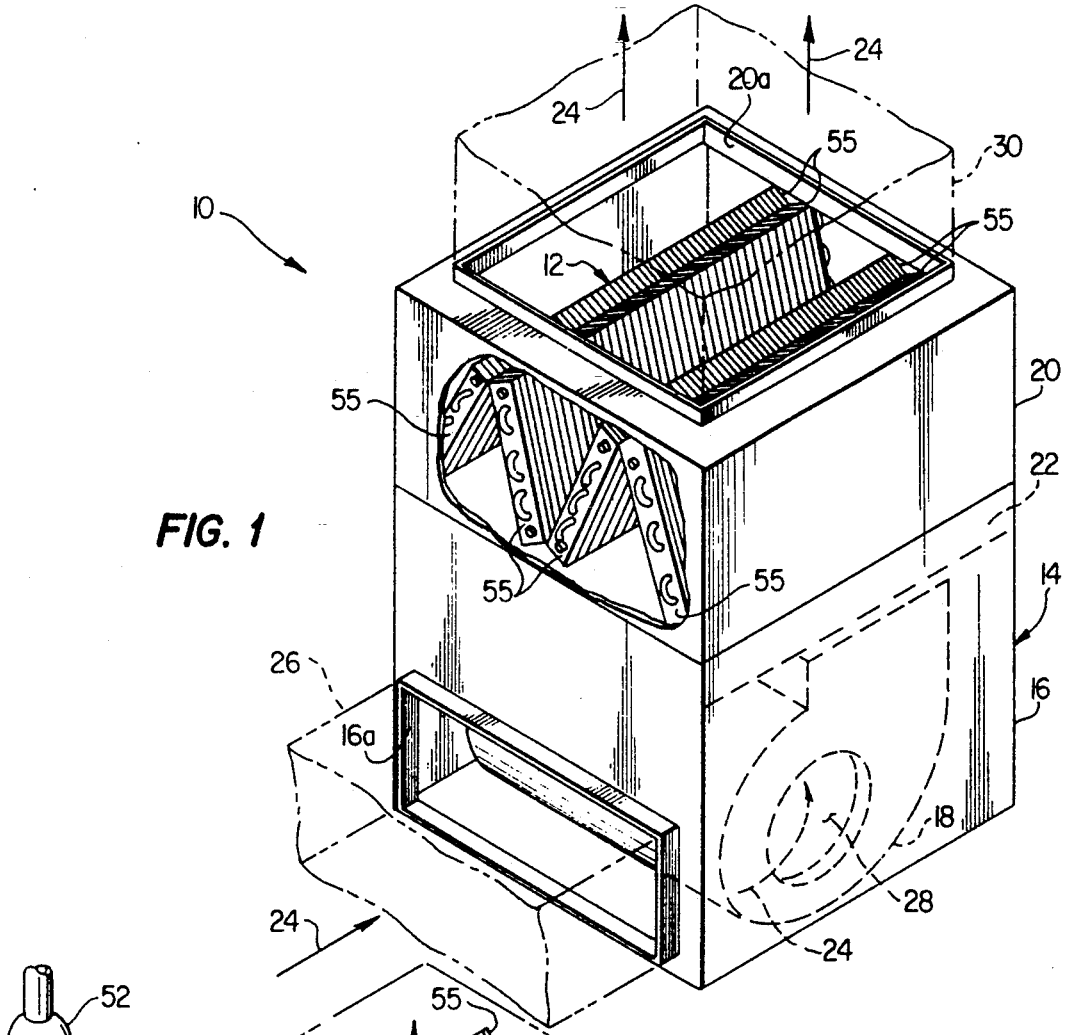
FIG. 1 is a partially cut-away schematic perspective view of a representative forced air furnace or air handler having installed thereon a compact, modular refrigerant coil which embodies principles of the present invention.

Perspectively illustrated in FIG. 1 is a typical indoor up-flow combination heating and cooling system 10 having incorporated therein a uniquely configured air-cooling evaporator coil 12 which embodies principles of the present invention. System 10 includes a housing 14 having a return air section 16 with a blower 18 disposed therein, and a coil housing section 20 disposed above the return air section 16. The coil 12, and a suitable air-heating structure 22 (such as an electric resistance heating coil or a fuel-fired heat exchanger) are operatively mounted within the housing section 20 and housing section 16, respectively.

During cooling operation of the system 10, return air 24 from the conditioned space served by the system is drawn into the housing return air section 16, by the blower 18, through a return duct 26 suitably connected to a housing opening $16_a$. Return air 24 entering the housing section 16 is drawn into the blower inlet 28 and forced by the blower 18 upwardly across the heating-/cooling coil 12. The cooled or heated air 24 is then flowed back to the conditioned space through a suitable supply duct 30 connected to top side opening $20_a$ in the housing section 20.

Figure 2:
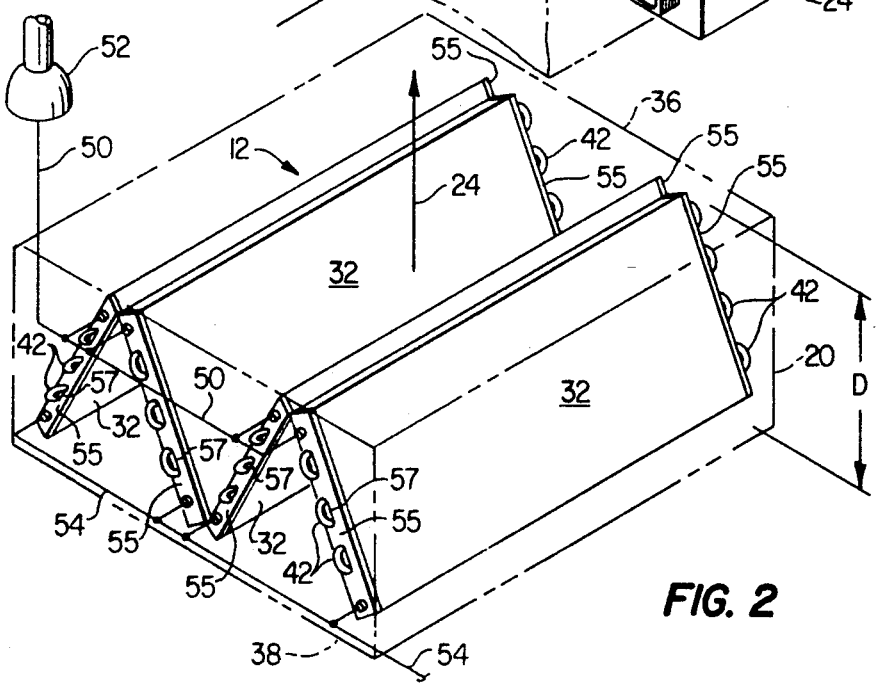
FIG. 2 is an enlarged scale perspective view of the modular coil removed from the furnace.
Figures 2A, 3A:
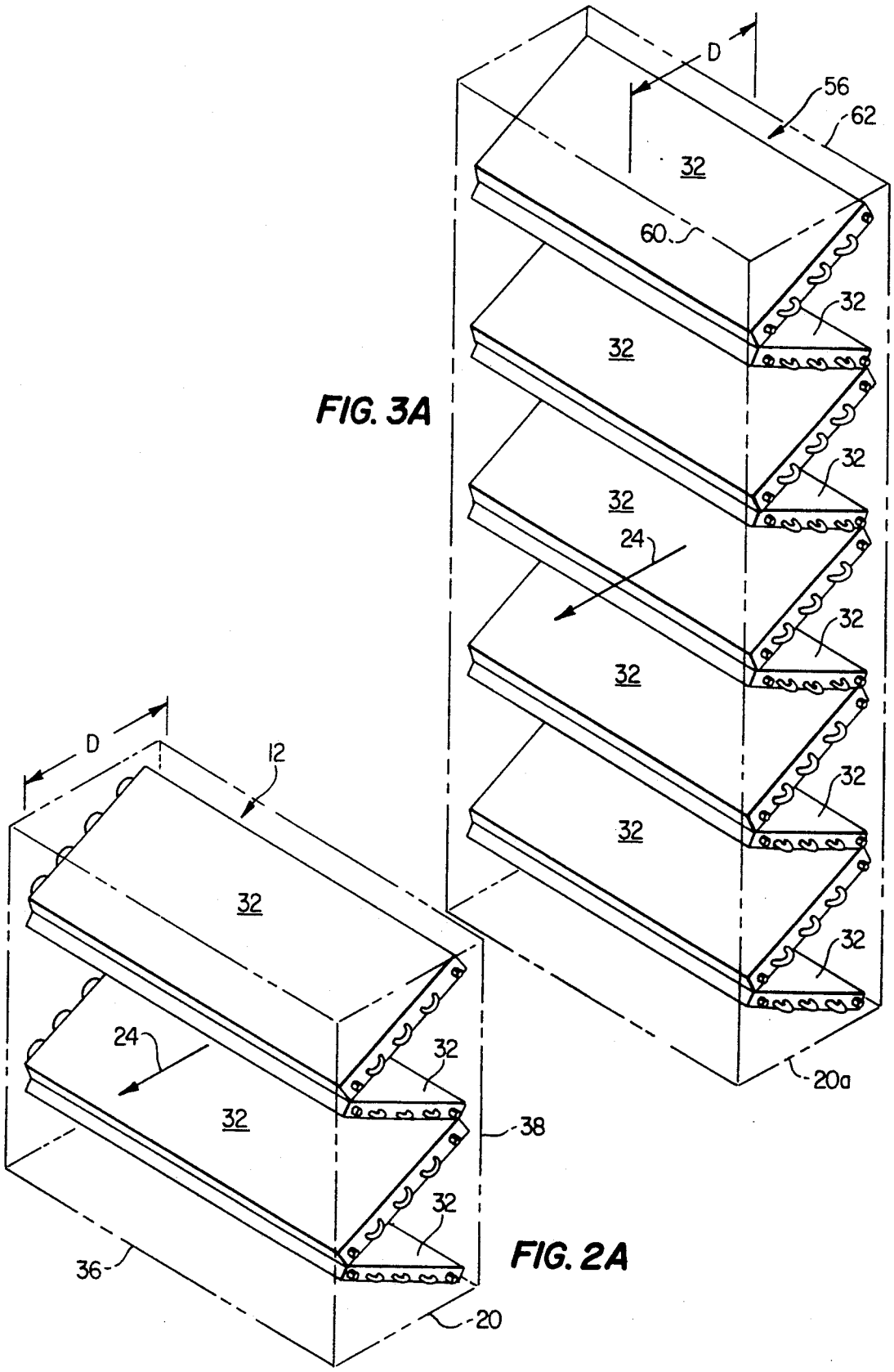
FIG. 2A is a perspectives view of the FIG. 2 modular coil in an alternate horizontal air flow orientation thereof.
FIG. 3A is a perspective view of the larger tonnage FIG. 3 modular coil in an alternate, horizontal air flow orientation thereof.
Figure 4:
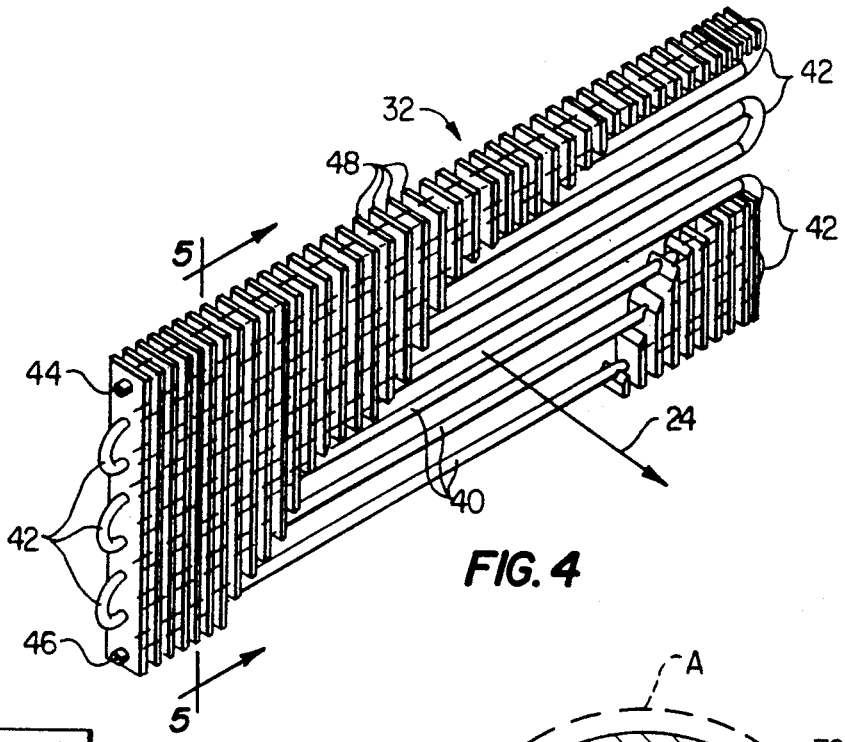
FIG. 4 an enlarged scale, partially cut-away perspective view of one of the series of identically sized, single row, single circuit refrigerant coil modules used to form the representative refrigerant coils shown in FIGS. 2, 2A, 3 and 3A.

Turning now to FIGS. 2 and 4, according to an important feature of the present invention, the coil 12 (FIG. 2) is formed from four identically sized flat refrigerant coil modules 32 (FIG. 4) arranged in an accordion-pleated configuration and supported within the housing 20 which has an open top side 36 and an open bottom side 38. As illustrated, the coil 12 has a depth D extending parallel to the flow of air 24 externally across the coil. As depicted in FIG. 2A, the coil 12 may be repositioned, if desired, to provide for horizontal flow of the air 24 externally across the coil. In either the horizontal or vertical orientation of coil 12 the air flow across the coil may be opposite to that shown if desired.

Turning now to FIG. 4, the flat refrigerant coil module 32 utilized to form the modular coil 12 includes a single row of parallel, laterally spaced apart refrigerant heat exchange tubes 40 connected at their ends by conventional "U" fittings 42 to form a single refrigerant circuit having an open inlet end 44 and an open outlet end 46. Transversely connected to the heat exchange tubes 40 are a longitudinally spaced series of heat exchange fins 48. The coil 12 (FIG. 2) is operatively connected in the refrigeration circuit serving the system 10 by conventional refrigerant supply piping 50 connected to the tube inlets 44 of the coil modules 32 and provided with refrigerant expansion means 52, and refrigerant return piping 54 connected to the open tube outlets 46 of the four coil modules 32. If desired, the refrigerant flow through the coil modules 32 can be reversed simply by connecting the supply piping to the module outlets, and connecting the return piping to the module inlets.

With reference now to FIGS. 1 and 2, the coil 12 is supported within its associated housing 20 by means of two sets of interconnected support bars 55 secured to the opposite ends of the coil modules 32 and having slots 57 through which the U-fittings 42 outwardly pass. At their lower ends the bars 55 a. connected to conventional drain pan means (not shown) that are fastened to housing 20. The coils depicted in FIGS. 2A, 3 and 3A are supported in a similar manner within their associated housings.

According to a key aspect of the present invention, as may be seen by comparing FIGS. 2 and 3, a series of identical flat refrigerant coil modules 32 may be utilized to form a series of modular, accordion-pleated refrigerant coils, having identical coil depths D and different nominal air conditioning tonnages depending upon the number of modules 32 utilized to form the particular accordion pleated coil. For example, the larger coil 56 shown in FIG. 3 is formed from ten of the identically sized modules 32 arranged in an accordion pleated fashion and operatively supported in an appropriately larger housing 20*a* having an open top side 60 and an open bottom side 62. As may be seen by comparing FIGS. 3 and 3A, the larger coil 56, like the smaller coil 12, may be positioned in either vertical or horizontal air flow orientations The refrigerant coil module 32 illustrated in FIG. 4 representatively has a nominal air cooling capacity of 0.5 tons (6,000 BTU/HR.) Accordingly, the modular coil 12 has a nominal air cooling capacity of 2.0 tons, and the larger coil 56 has a nominal air cooling capacity of 5.0 tons. It will be appreciated, however, that the nominal air conditioning tonnage of each coil module 32 could be greater or smaller if desired. It will also be appreciated that the two illustrated coils 12 and 56 are merely representative of a wide variety of accordion pleated coils that could be formed utilizing different numbers of the identically sized coil modules 32, ranging from a two module coil to a coil having as many identically sized modules as is necessary to provide the required total air conditioning tonnage of the coil. For system applications, the minimum number of modules 32 utilized in a given coil is preferably three.

Compared to conventional "A"-coils utilized in systems such as the system 10 depicted in FIG 1, the present invention's concept of utilizing selected numbers of identically sized coil modules to form accordion-pleated refrigerant coils of mutually different air conditioning capacities provides a variety of advantages. For example, as is well known, the production of A-coils of the different air conditioning capacities typically needed in a given equipment line necessarily entails the fabrication and inventorying of several differently sized refrigerant coil slabs used to form the A-coils. This, of course, requires increased production machinery and associated manufacturing floor space. Additionally, to accommodate the differently sized refrigerant coil slabs, it is necessary to produce a corresponding number of differently sized heat exchange fins. Moreover, the air conditioning capacity increments between successively larger A-coils, particularly at the upper end of the equipment's capacity spectrum, is typically considerably larger than 0.5 tons. This often results in the necessity of considerably oversizing the system's actual air conditioning capacity compared to the calculated air conditioning requirement for the conditioned space served by the system.

In the present invention, however, it is only necessary to fabricate and inventory refrigerant coil slabs of a single size to produce all of the different capacity coils needed in a typical equipment line. This advantageously reduces the overall coil manufacturing costs, thereby reducing the overall manufacturing costs of the system 10. Another advantage provided by the coil manufacturing method of the present invention is that the incremental air conditioning capacity increase between successively larger accordion pleated coils may be advantageously made uniform, and quite small, throughout the air conditioning capacity range of the particular equipment line. Using the illustrated coil module 32 as the "building block" for a series of different capacity air conditioning coils, this uniform increment would be 0.5 tons. The ability to economically provide this small air conditioning capacity increment permits the air conditioning capacity of the particular system to be very precisely matched to the actual air conditioning requirement of the conditioned space served by a particular system.

As previously mentioned, the coil depth D of each accordion-pleated coil fabricated from a selected number of the identically sized coil modules 32 may be easily made identical for each different capacity coil produced. This advantageously avoids the coil depth variation typically encountered when conventional A-coils are utilized. Accordingly, the coil housing length (in the air flow direction) necessary to accommodate each of the different capacity refrigerant coils of the present invention may be advantageously kept at a constant value regardless of which capacity air conditioning coil is installed on the furnace, air handler or heat pump.

The "face velocity" of an air conditioning coil is conventionally defined as the total volumetric air flow passing through the coil divided by the total effective upstream side surface area of the coil. Thus, the face velocity of a coil having a 2.0 square foot face area across which a 1200 cubic feet/minute air flow occurs would be 600 feet/minute. For many years it has been thought necessary to size refrigerant coils (such as conventional A-coils) used in the indoor sections of air conditioning equipment in a manner such that the coil face velocity is maintained within the 300–500 feet/minute velocity range.

Conventional coil design wisdom has been that a coil face velocity below about 300 feet/minute results in unacceptably low coil heat exchange efficiency, while a coil face velocity above about 500 feet/minute yields an unacceptable degree of condensate "blow through" and additionally raises the air pressure drop across the coil to an undesirable level.

Also in accordance with conventional coil design theory, the two refrigerant coil slabs used to define refrigerant A-coils are of a multi-row, multi-circuit construction for purposes of heat exchange efficiency. This multi-row/multi-circuit configuration, coupled with the coil face area needed to keep the face velocity of the coil within the traditional 300–500 feet/minute range, typically results in an air pressure drop across the coil that, as a practical matter, precludes the use in the coil of "enhanced" fins (i.e , fins of, for example, a lanced or louvered construction designed to increase the air-to-fin heat exchange efficiency. Typically, the increased pressure drop associated with this type fin enhancement is unacceptable in conventional refrigerant A-coils. Accordingly, conventional A-coils are usually provided with unenhanced fins.

The present invention significantly departs from this conventional refrigerant coil design theory in several regards. For example, as previously mentioned, each of the identically sized coil modules 32 is of a single row, single refrigerant circuit design. Additionally, the face area of each coil module 32 is preferably sized so that the face velocity of each multi-module coil, during operation of the air conditioning unit in which it is installed, is below the conventional 300 feet/minute lower limit. Preferably, such face velocity is in the range of from about 100 feet/minute to about 200 feet/minute. This face velocity reduction desirably and quite substantially reduces the air pressure drop across the coil, thereby reducing the power requirements for the furnace blower. Specifically, the modular coils of the present invention are preferably designed to operate with air pressure drops of less than about 0.10".

Figure 5A:
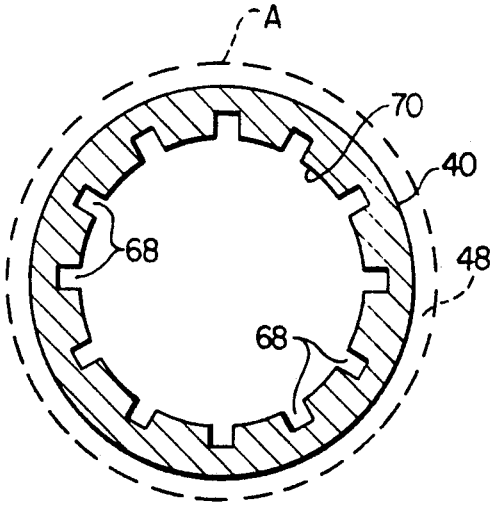
FIG. 5A is an enlargement of the circled area "A" in FIG. 5.
Figure 5:
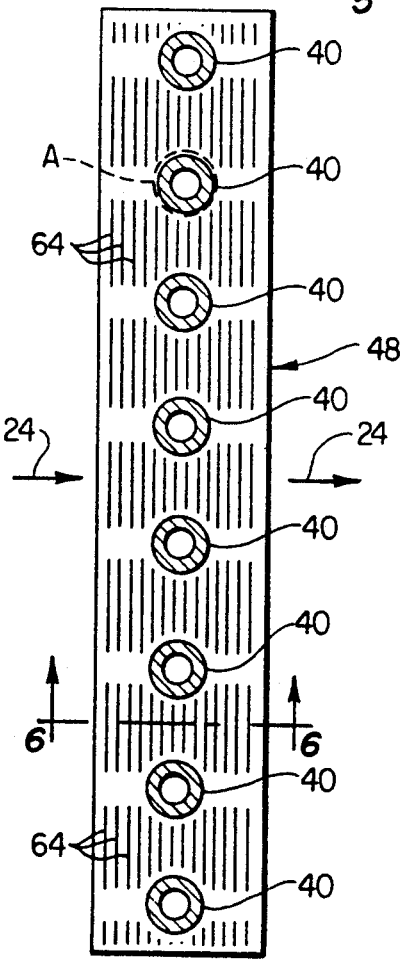
FIG. 5 is an enlarged scale cross-sectional view through the refrigerant coil module taken along line 5—5 of FIG. 4.
Figure 6:
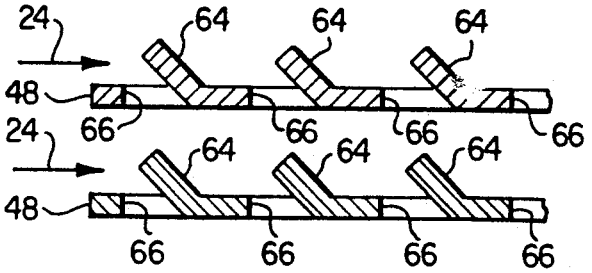
FIG. 6 is an enlarged scale partial cross-sectional view through an adjacent pair of enhanced heat exchange fins on the refrigerant coil module.

In turn, this substantial air pressure drop reduction permits a closer fin spacing to be used in the coil modules 32, the module fin spacing preferably being in the range of from about 16 fins/inch to about 22 fins/inch (compared to the 10–14 fins/inch used in conventional A-coils). The lowered face velocity of the accordion-pleated refrigerant coils of the present invention also permits the fins 48 to be of an enhanced construction as illustrated in FIGS. 5 and 6. While a variety of fin enhancement designs could be used, a representative louvered fin enhancement design is illustrated in FIGS. 5 and 6, and comprises louvers 64 formed in the fins and extending at an angle relative to the fin bodies and positioned adjacent fin. Openings 66 resulting from the formation of the louvers 64. This fin enhancement desirably increases the air-to-fin heat exchange efficiency of the coil modules 32. In the illustrated preferred embodiment of the coil module 32, its tubes 40 are internally enhanced, preferably by the formation of a circumferentially spaced series of radial grooves 68 (FIG. 5A) formed in the interior side surface 70 of each tube and extending along its length. This internal tube enhancement desirably increases the tube-to-refrigerant heat exchange efficiency of each coil module 32.

While the accordion-pleated refrigerant coils of the present invention have been illustrated in conjunction with the evaporator section of a forced air furnace 10, it will readily be appreciated by those skilled in this art that the coils of the present invention could also be used in other air conditioning applications such as in heat pumps or other types of air conditioning apparatus. Additionally, downflow or horizontal flow units could also have the coils of the present invention incorporated therein.

The single row/single circuit configuration of each of the coil modules 32 serves to maximize the primary heat transfer performance (i.e., the tube-to-refrigerant heat transfer efficiency of the accordion-pleated refrigerant coil by maintaining a generally optimum refrigerant flow per circuit. When smooth coil tubes are utilized, this permits the optimization of refrigerant pressure drop. When internally grooved or otherwise internally enhanced coil tubes are used, this allows for the optimization of refrigerant pressure drop with shorter length tubes.

The single row/single circuit design of the coil modules also permits the secondary heat transfer performance (i.e., the air-to-fin heat exchange efficiency) of the coil to be maximized by allowing the maintenance of an optimum cfm/ton air flow ratio. In turn, this provides the previously mentioned low air face velocity for the coils of the present invention which yields reduced air side pressure drops, reduces water blow-off potential, and maintains the latent capacity for the coil. With plain (i.e., unenhanced) fins, this permits a considerably higher fin density than is achievable with conventional evaporator coils. With enhanced fins and unenhanced coil tubes, this permits a low fin density. On the other hand, when enhanced, internally grooved coil tubes are used, this permits a considerably higher enhanced fin density to match the shorter overall tubing length requirements.

The foregoing detailed description is to be clearly understood as being given by way of illustration and example only, the spirit and scope of the present invention being limited solely by the appended claims.

What is claimed is:

1. A method of manufacturing first and second indoor air conditioning refrigerant coils having different nominal refrigeration tonnages, said method comprising the steps of:

providing a series of substantially identically sized flat refrigerant coil modules each defined by:

a single row of parallel, laterally spaced apart refrigerant heat exchange tubes serially interconnected to form a single refrigerant circuit in the refrigerant coil module, said single refrigerant circuit having an inlet end for receiving refrigerant from a source thereof and an outlet end for discharging the received refrigerant, and a longitudinally spaced series of heat exchange fins transversely connected to said heat exchange tubes;

forming said first indoor refrigerant coil using the step of securing a first plurality of said substantially identically sized coil modules in an accordion-pleated array having an inlet side collectively defined by side surfaces of said first plurality of said substantially identically sized coil modules and positionable to generally perpendicularly intercept and permit an external flow thereacross of a first predetermined operating flow rate of air to be conditioned;

forming said second indoor refrigerant coil utilizing the step of securing a second plurality of said substantially identically sized coil modules in an accordion-pleated array having an inlet side collectively defined by side surfaces of said second plurality of said substantially identically sized coil modules and positionable to generally perpendicularly intercept and permit an external flow thereacross of a second predetermined operating flow rate of air to be conditioned, the number of coil modules in said second plurality thereof being greater than the number of coil modules in said first plurality thereof; and configuring said first and second indoor refrigerant coils in a manner such that, when operatively traversed by their associated air flows, they each create a total air pressure drop of approximately 0.1"or less, and a coil face velocity for the air flow within the approximate range of from about 100 feet/minute to about 200 feet/minute.

2. The method of claim 1 wherein:

said steps of forming said first and second refrigerant coils are performed in a manner such that the depths of said first and second refrigerant coils, in the directions of intended air flow across the coils, are substantially identical.

3. The method of claim 1 further comprising the steps of:

connecting first refrigerant supply piping means to said inlet ends of said single refrigerant circuits of said substantially identical sized coil modules in said first plurality thereof, said first refrigerant supply piping means being operative to flow a refrigerant from a source thereof through said first plurality of coil modules, connecting first refrigerant return piping means to said outlet ends of said single refrigerant circuits of said substantially identically sized coil modules in said first plurality thereof, said first refrigerant return piping means being operative to receive refrigerant discharged from said first plurality of coil modules, connecting second refrigerant supply piping means to said inlet ends of said single refrigerant circuits of said substantially identically sized coil modules in said second plurality thereof, said second refrigerant supply piping means being operative to flow a refrigerant from a source thereof through said second plurality of coil modules, and connecting second refrigerant return piping means to said outlet ends of said single refrigerant circuits of said substantially identically sized coil modules in said second plurality thereof, said second refrigerant return piping means being operative to receive refrigerant discharged from said second plurality of coil modules.

4. The method of claim 1 wherein said configuring step includes the step of:

positioning said fins on said tubes in a manner such that the fin spacing on each of said refrigerant coil modules is in the range of from about 16 fins/inch to about 22 fins/inch.

5. The method of claim 1 further comprising the step of:

forming enhancement means on said fins for increasing the air-to-fin heat exchange efficiencies of said coil modules.

6. The method of claim 1 further comprising the step of:

forming internal enhancement means within said tubes for increasing the tube-to-refrigerant heat exchange efficiencies of said coil modules.

7. A method of fabricating a plurality of air conditioning refrigerant coils having different nominal refrigeration tonnages, said method comprising the steps of:

providing a series of substantially identically sized flat refrigerant coil modules each having a spaced series of refrigerant heat exchange tubes interconnected to form a refrigerant circuit in the refrigerant coil module, said refrigerant circuit having inlet means for receiving refrigerant from a source thereof and outlet means for discharging the received refrigerant, and longitudinally spaced heat exchange fins transversely connected to said heat exchange tubes;

forming a first refrigerant coil using the step of securing a first plurality of said substantially identically sized coil modules in an accordion-pleated array having an inlet side collectively defined by side surfaces of said first plurality of said substantially identically sized coil modules and positionable to intercept and permit an external flow thereacross of air to be conditioned; and forming a second refrigerant coil utilizing the step of securing a second plurality of said substantially identically sized coil modules in an accordion-pleated array having an inlet side collectively defined by side surfaces of said second plurality of said substantially identically sized coil modules and positionable to intercept and permit an external flow thereacross of air to be conditioned, the number of coil modules in said second plurality thereof being greater than the number of coil modules in said first plurality thereof.

* * * * *